United States Patent [19]

Grunert

[11] Patent Number: 4,568,017

[45] Date of Patent: Feb. 4, 1986

[54] SUPPORT FLAP FOR MOLDED TRAY

[75] Inventor: Bernd G. Grunert, Markham, Canada

[73] Assignee: Ivex Corporation, Toronto, Canada

[21] Appl. No.: 691,407

[22] Filed: Jan. 14, 1985

[51] Int. Cl.[4] ..... B65D 1/24

[52] U.S. Cl. ..... 229/2.5 R; 206/45.24; 206/45.33

[58] Field of Search ..... 229/2.5 R; 206/45.24, 206/45.33, 45.2; D9/345, 426, 428, 429, 455; 426/124, 128

[56] References Cited

U.S. PATENT DOCUMENTS

| | | | |
|---|---|---|---|
| 1,131,075 | 3/1915 | O'Donnell | 206/45.24 |
| 2,280,935 | 4/1942 | Stevens, Jr. | 206/45.24 X |
| 3,093,244 | 6/1963 | Middleton, Jr. et al. | 206/45.24 |
| 3,212,907 | 10/1965 | Caprioli | 206/45.33 X |
| 3,371,848 | 3/1968 | Ward et al. | 229/2.5 R |
| 3,638,849 | 2/1972 | Goings | 229/2.5 R |
| 3,685,649 | 8/1972 | Diehl | 206/45.24 X |
| 3,726,395 | 4/1973 | Duhy | 229/2.5 R X |

*Primary Examiner*—William Price
*Assistant Examiner*—Gary E. Elkins
*Attorney, Agent, or Firm*—Sim & McBurney

[57] ABSTRACT

An improved tray for containing biscuits and the like, adapted to be enclosed in a protective outer bag. The container has adjacent pockets for receiving biscuits and the like, and a flap at one end which can be folded to take up a position lying against the pocket adjacent that end. The flap has a part which is complementary to the pocket so that it can lie firmly against it, and the flap additionally has a bracing border which supports the container vertically when it is stood on its one end with the flap in contact with the end pocket.

8 Claims, 2 Drawing Figures

SUPPORT FLAP FOR MOLDED TRAY

This invention relates generally to containers for biscuits and the like, and has to do particularly with an open-topped container adapted to receive rows of biscuits, which can be then inserted into a protective outer bag for sale to the public.

BACKGROUND OF THE INVENTION

One conventional and typical way in which biscuits, cookies and the like are packaged and sold involves the use of tray-like containers adapted to hold the biscuits etc. in aligned rows, the whole tray plus the biscuits being enclosed within a sealed outer bag which contains the name of the product and other indicia. Normally, the bag is of opaque paper or metallized paper and snugly surrounds the box, thus maintaining the biscuits etc. in the troughs or pockets.

The conventional bag-tray arrangement suffers from two disadvantages. Firstly, most biscuits or cookies are rounded or oval, which means that the pockets defined by the tray or container are likewise rounded. When one of these rounded trays is utilized, the roundedness at one end of the container (the end that is at the bottom of the bag) causes the bag to fold or crumble so that it falls over backwards. This means that the bags cannot reliably be positioned on the store shelves. Secondly, the cookies or biscuits in the lowermost row often become broken or chipped due to impact against the bottom end of the bag, resulting in customer dissatisfaction and an unacceptable product.

An important consideration in the manufacture of trays of the kind under consideration is that they be readily blow- or vacuum-formed from flat stock. Generally speaking, the trays in the prior art which do have a squarish end are too complicated to be reliably blow- or vacuum-formed. One such example is U.S. Pat. No. 3,212,907, issued to Caprioli on Oct. 19, 1965. Other prior art trays achieve stability by deliberately deforming the lowermost pocket or cavity so that it is at right angles to the general extent of the tray. An example is U.S. Pat. No. 3,651,930, issued to K. W. Artz on Mar. 28, 1972. However, the deformed lower pocket puts great stress on the lowermost cookies or biscuits, leading to a high incidence of breakage and customer dissatisfaction.

Other prior patents of interest are the following:

U.S. Pat. No. 4,012,530, issued Mar. 15, 1977 to Holden;

U.S. Pat. No. 3,322,267, filed May 30, 1967 to Weiss;

U.S. Pat. No. 3,740,238, filed June 19, 1973 to Graham.

GENERAL DESCRIPTION OF THIS INVENTION

In view of the above-described shortcomings of the prior art in this area, it is an aim of one aspect of this invention to provide an improved tray or container for biscuits and the like, in which all pockets may be formed to conform closely to the shape of the contained items, and which additionally has an extra provision by which to stabilize the tray for standing on its end.

More particularly, this invention provides an improvement in a container for biscuits and the like, the container having adjacent pockets for receiving the biscuits, and being adapted for insertion into a protective outer bag. The improvement comprises a flap attached to one end of the container and adapted to take up a position in which it lies against the pocket adjacent said one end, the flap having a portion complementary in shape to said end pocket, said flap further having bracing means which supports the container when stood on said one end with the flap in contact with said end pocket, the bracing means being a bordering wall on the flap, the bordering wall terminating at a plane which extends such that when the flap seats complementally against and is maintained against the end pocket, the container can be stood on its end and remain stable in that position.

GENERAL DESCRIPTION OF THE DRAWINGS

One embodiment of this invention is illustrated in the accompanying drawings, in which like numerals denote like parts throughout the several views, and in which:

FIG. 1 is a perspective view of a container constructed in accordance with this invention; and FIG. 2 is a sectional view through a bag which envelops the container, the container being filled with cookies or biscuits.

DETAILED DESCRIPTION OF THE DRAWINGS

Figure 1:
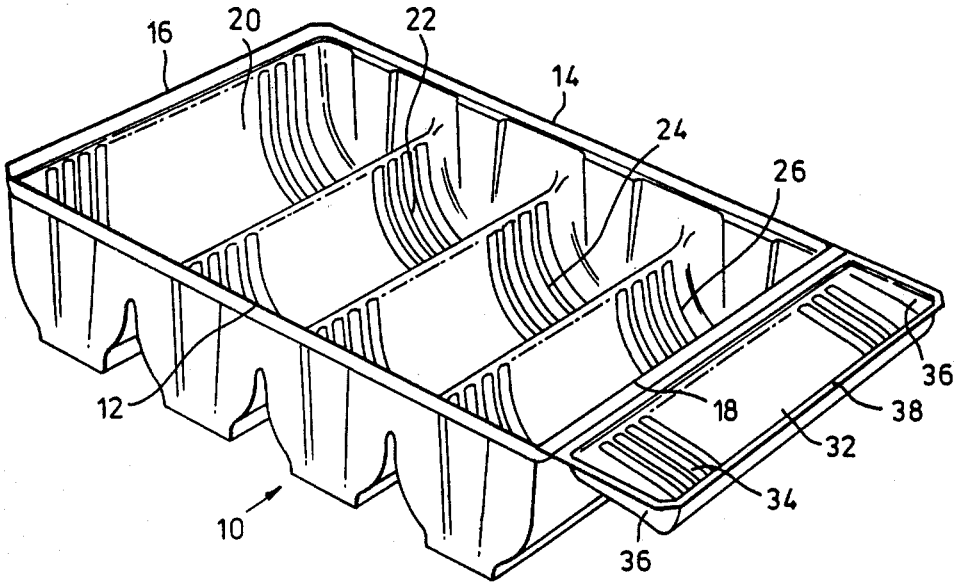

Attention is first directed to FIG. 1, which shows a container 10 having longitudinal side edges 12 and 14, and transverse end edges 16 and 18. The container 10 may be formed from a flat sheet of a material such as thin-walled transparent polystyrene, foam plastic or molded pulp, and defines, in the embodiment shown, four parallel transversely-extending pockets 20, 22, 24 and 26, each pocket being limited at its ends by end panels which are aligned with the longitudinal edges 12 and 14 of the container 10. As can be seen in FIG. 1, the pockets 20–26 are rounded and are intended to receive rounded or oval cookies 30 shown in FIG. 2. If desired, the side walls of each of the pockets 20–26 can be corrugated to facilitate retention of the cookies.

Figure 2:
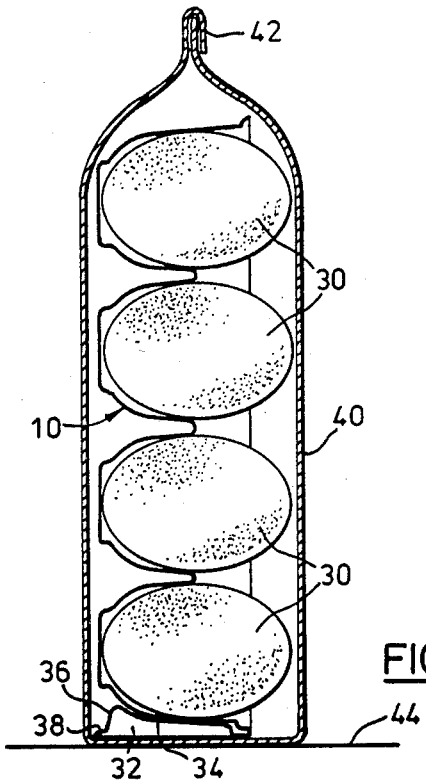

Integrally and hingedly connected at the transverse end edge 18 of the container 8 is a flap 32 which is formed in the position shown in FIG. 1, in which it extends substantially in the plane of the top of the container 10, but which is adapted to take up a position in which it lies against the pocket 26 which is adjacent the rightward end of the container 10 as seen in FIG. 1. The flap 32 has a curved panel 34 which is constructed to be complementary to the adjacent or rightward wall of the rightward end pocket 26, and the flap 32 further has bracing means adapted to support the container when stood on its rightward end with the flap in contact with the end pocket 26. More precisely, the bracing means is a bordering wall 36 which, in the FIG. 1 configuration, extends generally upwardly around the panel 34 (except for its hinge edge connection to the container 10). The bordering wall 36 has an outwardly projecting flange 38 which lies substantially in a common plane, and which takes up a substantially horizontal position when the container 10 is stood on its rightward end with the flap 32 folded down against the end pocket 26. This configuration is shown in FIG. 2, which also shows the entire container 10 and the contained biscuits 30 enclosed in a typical bag 40 which is closed at the top 42, and at the bottom rests upon a surface 44.

It is thus seen that the improvement provided herein allows the container 10 to have a "squared-off" end, even though the lowermost pocket 26 may be rounded or some other non-planar shape. The squared-off nature of the bottom end of the container 10 allows the bag 40 to stand upright without any danger of falling over, and additionally the flap 32 adds an extra layer of protection for the bottom pocket 26 and the goods which that pocket contains.

It will further be appreciated that the design of the flap 32 is such that it can be made to conform to virtually any configuration of the adjacent wall of the pocket 26, whether curvilinear or other, and still fulfil its function of "squaring-off" the end of the container to allow the latter to be stood on its end.

Those skilled in the art will appreciate that the container 10 may be made by blow-molding, injection molding, vacuum forming or pulp molding.

While one embodiment of this invention has been illustrated on the accompanying drawings and described hereinabove, it will be appreciated that changes and modifications may be made therein without departing from the essence of this invention, as set forth in the appended claims.

I claim:

1. In a container for biscuits and the like, the container having adjacent pockets for receiving the biscuits, the container being adapted for insertion into a protective outer bag, the improvement which comprises:

a flap attached to one end of the container and adapted to take up a position in which it lies gainst the pocket adjacent said one end, the flap having a portion complementary in shape to said end pocket, said flap further having bracing means which supports the container when stood on said one end with the flap in contact with said end pocket, the bracing means being a bordering wall on the flap, the bordering wall terminating at a plane which extends such that when the flap seats complementally against and is maintained against the end pocket, the container can be stood on its end and remain stable in that position.

2. The invention claimed in claim 1, in which the flap is integrally hinged to said one end of the container.

3. For insertion into a protective outer bag, a container for biscuits and the like, comprising:

a plurality of adjacent pockets for receiving the biscuits, and a flap attached to one end of the container and adapted to take up a position in which it lies against an end pocket adjacent said one end, the flap having a portion complementary in shape to said end pocket, said flap further having bracing means which supports the container when stood upright on said one end with the flap in contact with said end pocket, the bracing means being a bordering wall on the flap, the bordering wall terminating at a plane which extends such that when the flap seats complementally against and is maintained against the end pocket, the container can be stood on its end and remain stable in that position.

4. The invention claimed in claim 3, in which the end pocket has a curvilinear profile.

5. The invention claimed in claim 3, in which all said pockets are substantially identical in profile, the profile being curved.

6. The invention claimed in claim 5, in which each said pocket is elongated and extends across the width of the container.

7. The invention claimed in claim 6, in which the flap is integrally hinged to said one end of the container.

8. The combination of a container as claimed in claim 4, biscuits within the container, and a protective outer bag surrounding said container.

* * * * *